United States Patent [19]

Bradley

[11] Patent Number: 4,492,402

[45] Date of Patent: Jan. 8, 1985

[54] COIL UP-ENDING GRAB

[75] Inventor: Harvey Bradley, East Prospect, Pa.

[73] Assignee: Bradley Lifting, Corp., York, Pa.

[21] Appl. No.: 479,697

[22] Filed: Mar. 28, 1983

[51] Int. Cl.[3] ..... B66C 1/22

[52] U.S. Cl. ..... 294/103 CG; 294/106

[58] Field of Search ..... 294/103 CR, 103 R, 104, 294/111, 112, 88, 86 R, 67 R, 67 A, 106

[56] References Cited

U.S. PATENT DOCUMENTS

| | | | |
|---|---|---|---|
| 2,374,120 | 4/1945 | Mueller et al. | 294/103 |
| 2,744,780 | 5/1956 | Dixon | 294/115 |
| 2,816,792 | 12/1957 | Dixon | 294/103 |
| 2,925,300 | 2/1960 | Keller | 294/103 CG |
| 3,680,907 | 8/1972 | Siegwart | 294/103 CG |
| 4,097,084 | 6/1978 | Russell | 294/104 |

*Primary Examiner*—James B. Marbert

*Attorney, Agent, or Firm*—Samuel M. Learned, Jr.

[57] ABSTRACT

A special purpose grab adapted specifically for on-site employment in clamping and up-ending relatively narrow width reels of coiled strip material for the turning thereof from either an axis vertical-to-horizontal configuration, or visa versa.

6 Claims, 12 Drawing Figures

10
20
30
12
14
16
18
22
24
26
28
32
34
36
38
40
42
44
46
48
50
52
54
56
58
60
62
64
66
68
70
72
74
76
78
80
82
84
86
88
90
92
94
102
2
2

10
12
14
16
18
20
22
24
26
30
32
34
36
38
40
44
46
48
50
52
54
60
62
64
66
68
70
71
72
74
76
78
80
84
86
88
90
92
94

"a"
"b"
10
12
14
16
18
20
22
24
26
28
30
32
42
44
48
52
70
76
78
86
96
98
100
102

COIL UP-ENDING GRAB

BACKGROUND OF THE INVENTION

The present invention relates to a special purpose grab used in association with a lift and positioning device such as an overhead crane, the combination of which is employed to locate the grab for clampably engaging and thereafter up-end turning a reel of coiled strip material from an axis vertical-to-horizontal disposition as would normally be necessary for the loading thereof on coil material conversion machinery, exemplary of which employment use would be as in the handling of steel coil material during movement from a horizontal palletized shipping and storage configuration to an up-ended vertical configuration for the installation thereof upon a reel stand for infeed to a cutting press or some such similar piece of equipment.

Because of the simplicity of the device taught herein it is well suited for handling coils of limited size variation in width and diameter, and is particularly suited for the handling of coils with a width of less than one-third of the diameter, but, however, not of a width less than one-tenth of the diameter, with a total width to diameter variation of the coil to be handled by the device hereof not to exceed two-to-one.

Relatively simple narrow width coil engagement and lifting devices would be generally similar to that as taught by Mueller et al in U.S. Pat. No. 2,374,120 dated Apr. 17, 1945, wherein a pivotally acting lever-arm structure is adapted for overhead crane suspension for the engaging and lifting of coiled reels of strip material, wherein the device automatically disconnects from a coil load when lowered into place upon a support surface, but, however, is not per se designed to accommodate coil up-ending.

Another narrow width coil handling device, which is adapted to provide coil turning from an axis vertical-to-horizontal configuration by a structure that is distinguished but by a method of employment that is similar to that of the instant invention, is as shown in U.S. Pat. No. 2,744,780 to Dixon, dated May 8, 1956. A subsequent teaching by Dixon, in his U.S. Pat. No. 2,816,792 dated Dec. 17, 1957, is characteristic of a relatively simple up-ending grab device for handling wide width coils wherein the up-end turning of a clamped coil from one position to another is incident to the application of an overhead crane-engaged lifting force to the device and is dependent upon engagement positioning thereof about the dog-leg periphery of a C-clamp frame member.

Applicant's instant invention embodies as a subassembly structural feature thereof a manually operated latch-and pin lever arm lock and release device being functionally similar to, but, again, structurally distinguished from the cylindrical object lifting grab teaching by Russell in his U.S. Pat. No. 4,097,084 dated June 27, 1978, which is provided with a cam operated clamp lock that is engaged and released by manual manipulation.

As pointed out above, some of the features of the instant invention have, in some respects, both structural and/or functional similarities to various of those teachings separately set forth in the prior art disclosures heretofore cited and briefly discussed. However, as will hereinafter be pointed out, the instant invention is distinguished from said earlier inventions in one or more ways in that the present invention has utility features and new and useful advantages, applications, and improvements in the art of narrow width coil grab up-enders not heretofore known.

SUMMARY OF THE INVENTION

It is the principal object of the present invention to provide a coil up-ending grab adapted to clampably engage and thereafter effect the up-end turning of a reel of narrow width coiled strip material from a core axis vertical-to-horizontal disposition, or visa versa.

It is another object of the present invention to provide a coil up-ending grab provided with a visual indicator for displaying the obtaining and maintaining of operational clamp pressure engagement upon a reel of coiled strip material for up-ending handling.

Still another object of the present invention is to provide a coil up-ending grab which is mechanically simple and highly reliable in operation, safe and easily maintained, and capable of being operated by one not posessed of special skills or training.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 3 is a simplified side elevation view of the coil up-ending grab comprising the instant invention, shown suspended from an overhead crane chain, as the same would appear during location movement thereof by means of said overhead crane prepatory to clampably engaging and up-ending a reel of narrow width coiled strip material.

FIG. 4 is a simplified sequential side elevation view of the coil up-ending grab shown in located placement upon a reel of narrow width coiled strip material just prior to the clampable engagement thereof.

FIG. 5 is a continuing simplified sequential side elevation view of the coil up-ending grab shown in clampable engagement of the reel of narrow width coiled strip material with the operational clamp pressure visual indicator on.

FIG. 6 is a continuing simplified sequential side elevation view of the coil up-ending grab shown with the latch-and-pin assembly released and the L-shaped lever arm assembly thereof pivotally displacing upon crane chain elevation.

FIG. 7 is a continuing simplified sequential side elevation view of the coil up-ending grab shown in the process of effecting coil up-ending and core axis displacement thereof from a vertical-to-horizontal re-orientation.

FIG. 8 is a continuing simplified sequential side elevation view of the coil up-ending grab shown with the L-shaped lever arm assembly thereof in full pivotal extension and the coil core axial displacement from a vertical-to-horizontal re-orientation fully accomplished.

FIG. 9 is a continuing simplified sequential side elevation view of the coil up-ending grab shown with the coil re-positioned in a horizontal core axis disposition upon the original support surface and the grab clamping engagement thereof released prepatory to grab removal.

FIG. 10 is a continuing simplified sequential side elevation view of the coil up-ending grab shown in the extended position and removed from the up-ended coil.

FIG. 11 is a continuing simplified sequential side elevation view of the coil up-ending grab shown disposed in displacement from the previous work location and lowered upon a support surface for re-cocking of the L-shaped lever arm assembly.

FIG. 12 is a completed use cycle simplified sequential side elevation view of the coil up-ending grab showing the L-shaped lever arm assembly thereof re-cocked and locked with the latch-and-pin assembly and the clamping jaw retracted all in a condition for re-use employment.

DETAILED DESCRIPTION OF THE INVENTION

Figure 1:
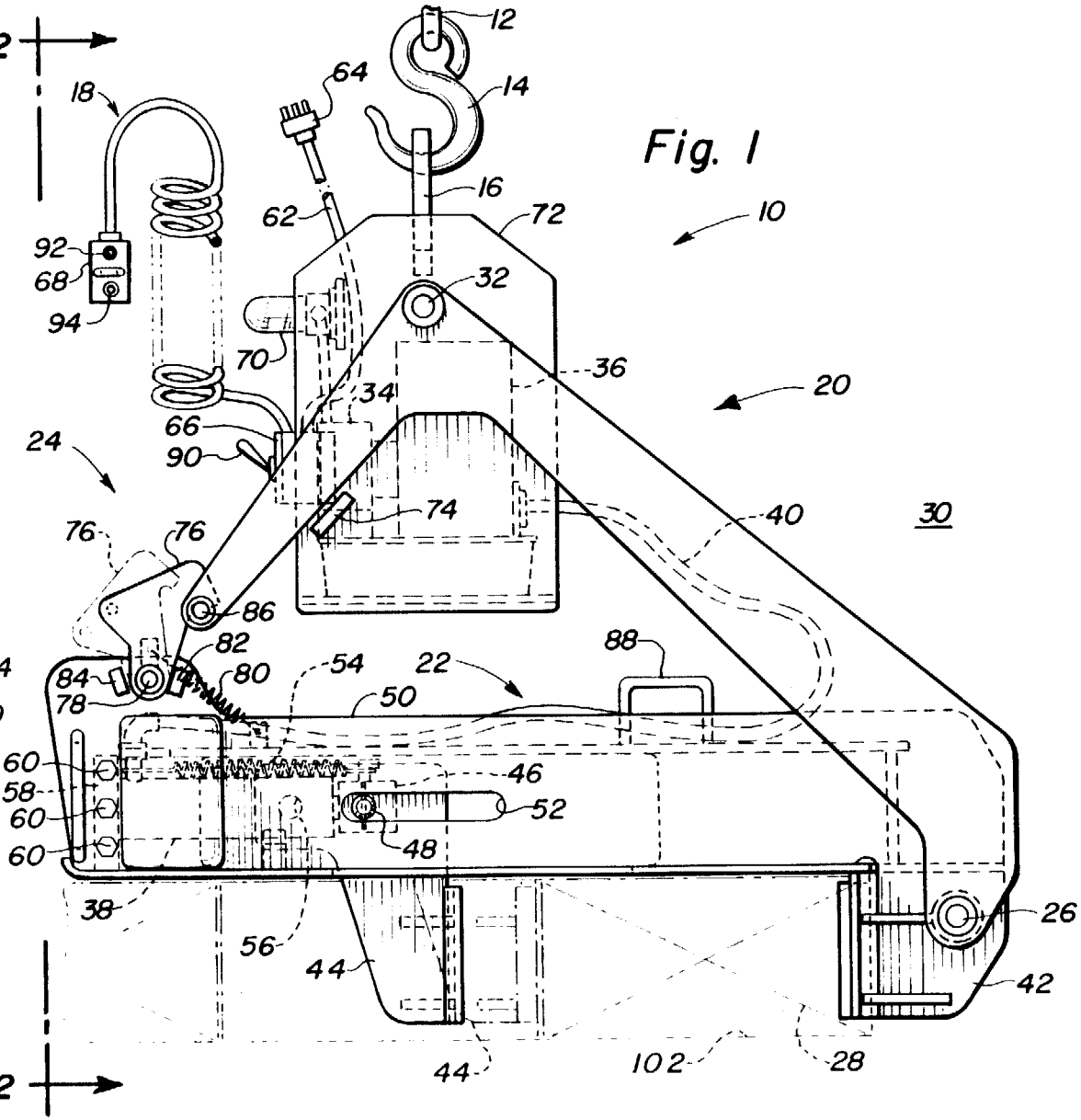
FIG. 1 is a side elevation view of the coil up-ending grab comprising the present invention shown in that mechanical configuration as the same would appear prepatory to clampably engaging an exemplary reel of narrow width coiled strip material for thereafter accomplishing a core axis vertical-to-horizontal up-ending thereof.

Referring to FIG. 1, the present invention is shown which comprises a coil up-ending grab 10 operationally suspended from an overhead crane by means of a crane chain 12 with a crane hook 14 connectably engaged through an opening in the grab lifting connector 16 suspendably supporting dependantly therefrom said grab 10 having as major sub-assembly components thereof the hydraulic power and control unit 18 pivotally assembled in the L-shaped lever arm assembly 20 clevis structure detachably assembled to the clamp deck 22 by means of the latch-and-pin assembly 25 at one end thereof and fixedly by up-ending pivot pintle 26 at the other end thereof, all of which when operator functioned through a use cycle sequence to be hereinafter more fully detailed and described, enables accomplishment of on-site clamping and up-ending of a relatively narrow width reel of coiled strip material 28, whereby the handling and turning thereof from either an axis vertical-to-horizontal configuration, or visa versa, is facilitated.

Referring again to FIG. 1 to describe in greater detail the cooperative component parts of this invention as well as generally the operation thereof, wherein the disposition of said grab 10 as shown in FIG. 1 is what is called and will be hereinafter referred to as the cocked-and-locked configuration 30, which is that disposition of said grab 10 when the same is operationally configured for clampably engaging a coil 28 for accomplishing the vertical-to-horizontal core axis up-end turning thereof.

In the first instance, it will be noted that the hydraulic power and control unit 18 is pivotally assembled within the clevis structure of the L-shaped lever arm assembly 20 by means of the power unit gimbal pins 32, which insures that as the grab 10 is operated through use cycle employment the hydraulic pump 34 and hydraulic reservoir 36 remain in an upright functional disposition at all times and thereby during continuous run thereof during coil up-ending and handling operations maintain the established operational hydraulic pressure in clamp cylinder 38 connected to said hydraulic power and control unit 18 by intercommunicating hydraulic conduit 40. It will be further noted that the outboard coil clamp 42 is fixed and the inboard coil clamp 44 connectably assembled to the cylinder piston 46 by means of the clamp connecting pull pin 48 inserted through respectively communicating openings therein is reciprocally operable bu means of said clamp cylinder 38 towards and away from the fixed outboard coil clamp 42 in both longitudinal and lateral displacement guidance within the clamp deck frame 50 by means of said connecting pin 48 having laterally extending portions which slidably engage and reciprocally operate within the clamp deck frame slotted inboard clamp guide opening 52, all of which mechanically accommodates grab 10 operation for obtaining aligned and secured clampable engagement of a coil 28. Additional structural features of the clamp deck 22 include a cylinder return spring 54 which facilitates recovery of the inboard coil clamp 44 to an open position, an alternate cylinder piston clamp connecting pull pin opening 56 which enables the accommodation of coils 28 of greater and varying core-to-outer diameter dimension, and a cylinder back-up safety plate 58 with shear bolts 60 as a clamp cylinder 38 relief feature in the event of an overload condition.

In addition to the hydraulic power and control unit 18 components already identified and described, there is an electrical power conduit 62 with plug 64 whereby electrical current is provided through the main switch box 66 for powering of the hydraulic pump 34 and other electrical components of said grab 10, the clamp operating switch box 68 which controls cycling of the clamp cylinder 38 in either extending to close or retracting to open the inboard coil clamp 44, a minimum safe clamping pressure indicating light 70, and a hydraulic pressure indicating gage 71 for facilitated checking of upper limit hydraulic pressures. Affixed to the hydraulic power and control unit side plates 72, at opposing lateral locations either external side surfaces respectively thereof, are positioned a set of L-shaped lever arm assembly cock-and-lock forward stops 74, which cooperatively function to facilitate cock-and-lock engagement of the latch-and-pin assembly 24 to be hereinafter more fully detailed.

The latch-and-pin assembly 24 comprised of the pivotally operable spaced latch plates 76 assembled upon pivot pin 78 pivotally operate thereon against catch spring 80 between forward and rearward arcuate deflection limit stops 82 and 84 respectively to releasably engage the L-shaped lever arm assembly engagement shaft 86 and either maintain said grab 10 in the cocked-and-locked configuration 30 or pivotally release the engagement shaft 86 and thereby enable pivotally deflected extension of said L-shaped lever arm assembly about the up-ending pivot-pintle 26 to thereupon effect coil 28 turning from a core axis vertical-to-horizontal disposition as will hereinafter be more fully detailed and described.

One additional structural component of the grab 10 assembly as illustrated in FIG. 1 is the clamp deck handle 88 mounted on the clamp deck 22, the purpose of which is to provide a convenient handhold for an operator to manually guide the crane suspended grab 10 into coil engageable position during use employment thereof.

The coil up-ending grab 10 as herein disclosed and described is preferably constructed from various metals, however, any other suitable materials or combinations thereof may be used.

Figure 2:
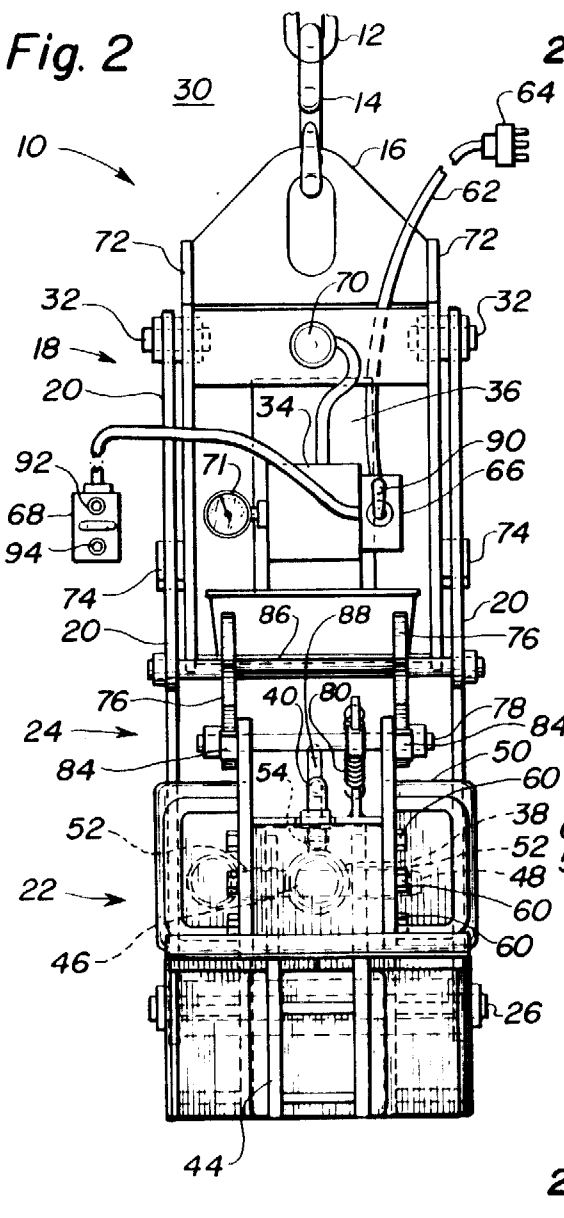
FIG. 2 is an end elevation view of the coil up-ending grab as seen along the line 2—2 of FIG. 1.

Referring now to FIG. 2, being an end elevation view of said coil up-ending grab 10 as seen from the operator side thereof, and illustrating more particularly the operator controls therefor. In start-up operation the main power switch 90 is turned on whereby the hydraulic power and control unit 18, including the clamp operating switch box 68, is activated providing operational and control power hydraulically to the cylinder piston 46 and electrically to the clamp operating switch box 68 open button 92 whereby the cylinder piston 46 is retracted and the inboard coil clamp 44 connectably assembled thereto is likewise retracted to the maximum open position consistent with the clamp connecting pull pin 48 setting as previously described. The inboard coil clamp 44 is cycled to engageably clamp a coil by pressing the close button 94. With, however, the unit powered as above-described, an operational check is conducted as follows. First, with the main power switch 90 on, and the cylinder piston 46 fully retracted by use of the open button 92 so that the inboard coil clamp 44 is cycled to the maximum open position, the hydraulic power unit 18 is run until the minimum safe hydraulic pressure is obtained, which is visually indicated by automatic illumination of the minimum safe clamping pressure indicating light 70, then, by use of the hydraulic pressure indicating gage 71, with the power unit 18 still running the operator insures that the upper hydraulic pressure limit of the established operational range is achieved. If at any time during coil handling and turning operational use employment of said grab 10 the minimum safe clamping pressure indicating light 70 should go off, the operational procedure at that time is to immediately bring the coil load to rest. In the foregoing regard, it is to be understood that although the grab 10 may be used for limited low level core axis horizontal transport of coils, the grab 10 is neither designed or intended for the overhead carrying of coils. It is also to be understood that although the pressure ranges within which the grab clamps may operate in terms of the minimum safe clamping pressure and the upper hydraulic pressure limit of the established operational range is generally between 5,000 to 7,000 psi, respectively, these limits establishing such a range are to be regarded as exemplary only and not per se restrictive.

Figures 3, 4, 5, 6, 7, 8, 9, 10, 11, 12:
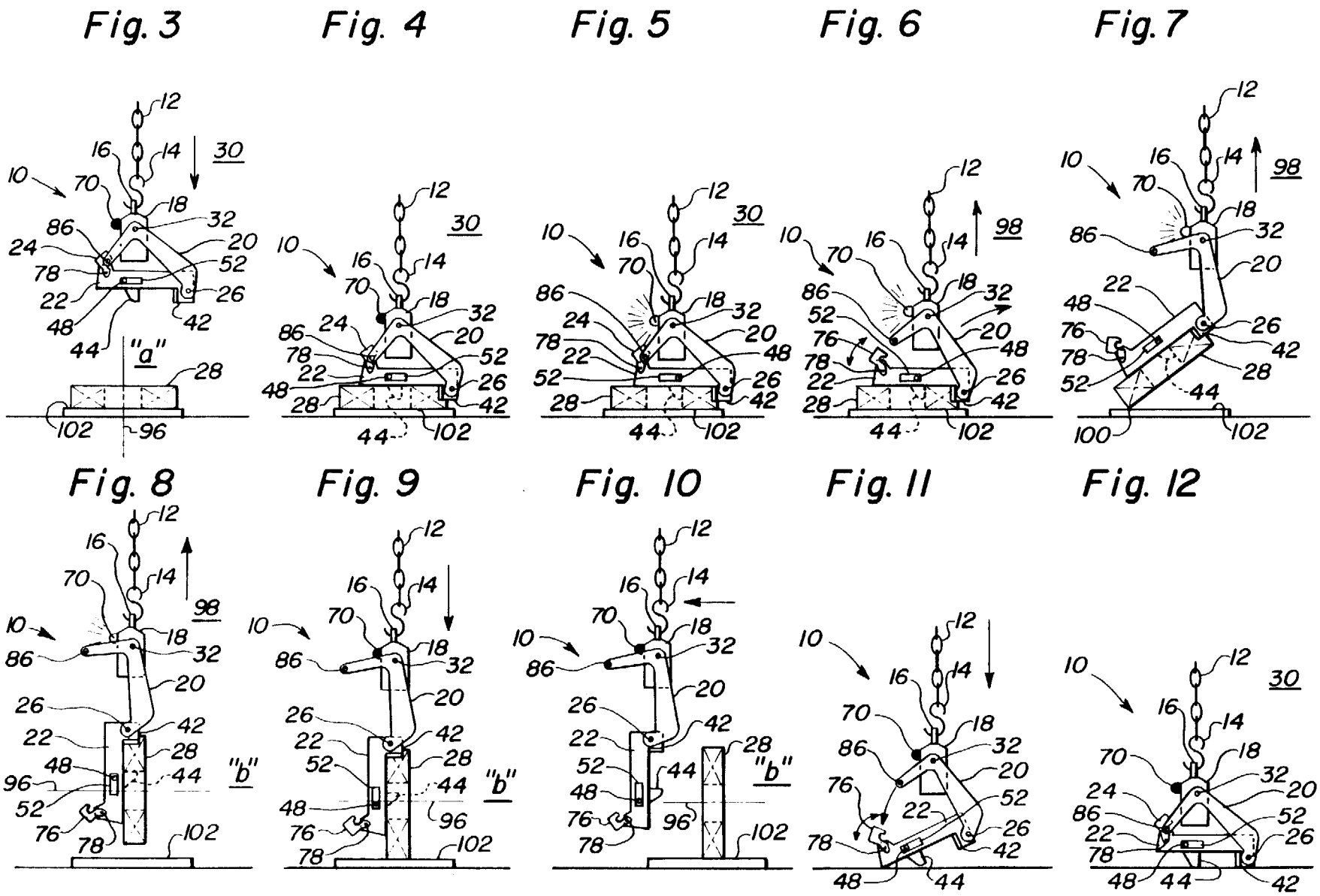

Turning now to a consideration of the grab 10 operational use sequence series as illustrated in simplified side elevation views by FIGS. 3 through 12 inclusive in more particularly describing the method of employment thereof in accomplishing the up-ending of a coil 28 from the core axis vertical configuration "a" as shown in FIG. 3 to the core axis horizontal configuration "b" as shown in FIG. 10, and then re-cocking and locking said grab 10 as progressively shown in FIGS. 11 and 12.

The illustration of FIG. 3 shows said coil up-ending grab 10 suspended from a crane chain 12 in the proximity of a coil 28 disposed with the core axis 96 thereof in a vertical configuration "a", wherein said grab 10 is in a typical use employment ready cocked-and-locked configuration 30 with the inboard coil clamp 44 thereof retracted and set at the maximum opening prepatory to overhead crane operator lowering and positioning upon said coil 28 for vertical-to-horizontal core axis up-end turning.

In FIG. 4 the grab 10 is shown in a lowered and located placement positioning upon the coil 28 just prior to the closing of inboard clamp 44, and prior to the hydraulic system obtaining the minimum safe pressure for coil grab and handling operations in that the minimum safe clamping pressure indicating light 70 remains unlit. It will be noted in both FIG. 4 and FIG. 5 the grab 10 remains in a cocked-and-locked configuration 30, but, however, as shown in FIG. 5 the minimum safe clamping pressure indicating light 70 is illuminated thereby evidencing sufficient hydraulic system pressure for commencement of safe handling operations. It will also be noted in FIG. 5 the operator has activated the clamp cylinder to effect a clampable closing of the inboard coil clamp 44 in compressive operational engagement of the coil 28 therebetween with the outboard coil clamp 42.

The view shown in FIG. 6 illustrates the initial grab 10 disposition in coil up-ending configuration 98 wherein the pivotally operable spaced latch plates 76 have been manually disengaged by the operator from the L-shaped lever arm assembly engagement shaft 86 thereby upon elevation of the crane chain 12 as by upward directed arrow indicated causing said L-shaped lever arm assembly 20 to deflect pivotally upward and outward about the up-ending pivot pintle 26 as by arcuate directed arrow indicated. During the initial coil up-ending employment of said grab 10, as illustrated in FIG. 6, there is L-shaped lever arm assembly pivotal extension only, however, as the limit of pivotal extension per se of said L-shaped lever arm assembly is reached a continued upward force on the crane chain 12 effects a combined continued pivotal extension of the L-shaped lever arm assembly 20 and a coil core axis 96 horizontal-to-vertical up-end turning of said coil from the point of clampable engagement thereof about a pivotal fulcrum point 100 being described as that remaining point of coil contact with the supporting surface 102 maintained during and through the course of combined L-shaped lever arm assembly 20 pivotal extension with coil up-end turning, all as illustrated in FIG. 7.

In FIG. 8 it will be noted that full extension of the L-shaped lever arm assembly 20 has been accomplished and along therewith a low-level elevated raising of said coil 28 above the supporting surface 102 in completing coil 28 up-ending to the core axis horizontal configuration "b". During all coil 28 handling operations in employing grab 10 to accomplish clampable engagement and vertical-to-horizontal core axis up-ending thereof, it will be further noted that a safe use condition is continually visually displayed to the operator by a continuous illumination of the minimum safe clamping pressure indicating light 70, as shown respectively in FIGS. 5 through 8 specifically therein detailing the grab 10 sequential use employment procedures.

The views respectively in FIGS. 9 and 10 show up-ended redeposit of said coil 28 in a core axis horizontal configuration "b" upon the support surface 102, and release and removal of the grab 10 therefrom by clamp cylinder retractive activation and withdrawal of the inboard coil clamp 44, and then overhead crane movement to withdraw the grab 10 to a removed location for accomplishing a re-cocking and locking thereof.

The view in FIG. 11 shows said grab 10 at a removed location with a lowering of the crane chain 12 so that the clamp deck 22 comes to rest upon the floor and results in a pivotal retraction and reclamping of the L-shaped lever arm assembly 20 in the cocked-and-locked configuration 30 as shown in FIG. 12 and afore-described, thus readied for re-use employment deployment.

It is evident from the foregoing use employment detailed description of grab 10 that a reverse procedure in the use employment thereof may be made in accomplishing facilitated repositioning of a coil from the core axis horizontal-to-vertical disposition.

Although the invention has been herein shown and described in what is conceived to be the most practical and preferred embodiment and method of employment thereof, it is recognized that departures may be made therefrom in both form and function within the scope of the invention, which is not to be limited to the details disclosed herein but is to be accorded the full scope of the claims so as to embrace any and all equivalent devices and apparatus and methods.

I claim:

1. A coil up-ending grab adapted for use in combination with an overhead crane, said coil up-ending grab comprising in combination:

a. an inverted L-shaped lever arm assembly having a spaced clevis structure insertably receiving by pivotal mounting means therebetween at the apex junctures of the respective long-leg members and the short-leg members thereof a hydraulic power and control unit with a support structure housing therefor upwardly mounting thereon a grab lifting connector for detachable connection with a crane hook of said overhead crane, b. a clamp deck provided with a fixed jaw and a moveable jaw adapted to engage coils for up-ending, said clamp deck insertably received pivotally within said spaced clevis structure of said inverted L-shaped lever arm assembly the long-leg member end thereof by a pintle means retainably inserted through a transverse set of aligned openings therein cooperatively with a corresponding opening provided within said clamp deck the fixed jaw end thereof, and c. a latch-and-pin assembly comprised of a pivotal latch means connectably assembled the moveable jaw end of said clamp deck upwardly thereof and adapted to releasably engage a pin means fixedly assembled transversely said inverted L-shaped lever arm assembly spaced clevis structure the short-leg member end thereof whereby a reel of coiled strip material compressively engaged between the fixed jaw and moveable jaw of said clamp deck may be up-ended from a core axis vertical to a core axis horizontal disposition upon release of said latch-and-pin assembly and elevation of said crane hook when cooperatively engaged with said grab lifting connector.

2. The coil up-ending grab according to claim 1 in which said hydraulic power and control unit is provided with a minimum safe hydraulic pressure visual indicating means.

3. The coil up-ending grab according to claim 2 in which said minimum safe hydraulic pressure visual indicating means is a light.

4. The coil up-ending grab according to claim 3 in which said light automatically illuminates and remains illuminated at all hydraulic pressures in excess of that established as being the minimum safe hydraulic operational pressure.

5. The coil up-ending grab according to claim 1 in which said moveable jaw is connectably assembled to a hydraulic piston and reciprocally operable towards and away from said fixed jaw by means thereof.

6. The coil up-ending grab according to claim 5 in which said hydraulic piston functionally operates from a hydraulic cylinder connected by an intercommunicating hydraulic conduit means with said hydraulic power and control unit.

* * * * *